US010837632B2

(12) United States Patent
Jiang

(10) Patent No.: US 10,837,632 B2
(45) Date of Patent: Nov. 17, 2020

(54) SPIRAL AIR GUIDE DEVICE AND STAGE LIGHT HEAT DISSIPATION SYSTEM PROVIDED WITH THE SPIRAL AIR GUIDE DEVICE

(71) Applicant: GUANGZHOU HAOYANG ELECTRONIC CO., LTD, Guangdong (CN)

(72) Inventor: Weikai Jiang, Gaungdong (CN)

(73) Assignee: GUANGZHOU HAOYANG ELECTRONIC CO., LTD (CN), Guangdong (CN)

( * ) Notice: Subject to any disclaimer, the term of this patent is extended or adjusted under 35 U.S.C. 154(b) by 0 days.

(21) Appl. No.: 16/346,085

(22) PCT Filed: Aug. 14, 2017

(86) PCT No.: PCT/CN2017/097312

§ 371 (c)(1),
(2) Date: Apr. 29, 2019

(87) PCT Pub. No.: WO2018/120847

PCT Pub. Date: Jul. 5, 2018

(65) Prior Publication Data

US 2019/0293275 A1 Sep. 26, 2019

(30) Foreign Application Priority Data

Dec. 30, 2016 (CN) ..... 2016 1 1259037

(51) Int. Cl.

| | |
|---|---|
| ***F21V 29/60*** | (2015.01) |
| ***F21V 29/67*** | (2015.01) |
| ***F21S 8/04*** | (2006.01) |
| ***F21S 8/00*** | (2006.01) |
| *F21W 131/105* | (2006.01) |
| *F21W 131/406* | (2006.01) |

(52) U.S. Cl.
CPC ..... *F21V 29/673* (2015.01); *F21S 8/00* (2013.01); *F21S 8/04* (2013.01); *F21V 29/60* (2015.01);

(Continued)

(58) Field of Classification Search
CPC ..... F21V 29/673; F21V 29/60; F21V 29/61; F21V 29/67; F21S 8/00; F21S 8/04; F21W 2131/105; F21W 2131/406
See application file for complete search history.

(56) References Cited

U.S. PATENT DOCUMENTS 8,057,071 B2 * 11/2011 He ..... F21K 9/233 362/234
8,480,269 B2 * 7/2013 Horng ..... F21V 29/677 362/373

(Continued)

FOREIGN PATENT DOCUMENTS

CN 102439353 A 5/2012
CN 102537691 A 7/2012

(Continued)

*Primary Examiner* — Bao Q Truong
(74) *Attorney, Agent, or Firm* — Muncy, Geissler, Olds & Lowe, P.C.

(57) ABSTRACT

A helical airflow guide device and a stage light heat dissipation system provided with the helical airflow guide device are provided. The helical airflow guide device comprises an airflow guide main body. The airflow guide main body is provided with multiple protruding portions. The multiple protruding portions are helically arranged, and gaps between adjacent protruding portions form multiple funnel-shaped airflow intake passages. Sizes of openings of the multiple airflow intake passages are different and change gradually. The multiple protruding portions are helically arranged, and the gaps between adjacent protruding portions form the multiple funnel-shaped airflow intake passages, such that entering airflows are circumferentially helical. In addition, (Continued)

the sizes of the openings of the multiple airflow intake passages are different and change gradually, such that the sizes of the airflow intake passages change uniformly, and the helical airflow guide device enables the airflow to enter uniformly, thereby achieving uniform heat dissipation.

14 Claims, 7 Drawing Sheets

(52) U.S. Cl.
CPC ..... *F21W 2131/105* (2013.01); *F21W 2131/406* (2013.01)

(56) References Cited

U.S. PATENT DOCUMENTS 8,562,179 B2 * 10/2013 Li ..... F21V 29/02 313/46
8,894,248 B2 * 11/2014 Quadri ..... F21V 9/04 362/294
2006/0256296 A1 * 11/2006 Yun ..... G03B 21/16 353/55
2010/0020537 A1 1/2010 He et al.
2010/0079732 A1 * 4/2010 Lo ..... F21V 29/02 353/61
2011/0216287 A1 * 9/2011 Kitamura ..... G03B 21/16 353/61
2016/0305639 A1 * 10/2016 Midali ..... F21V 29/60

FOREIGN PATENT DOCUMENTS

| | | | |
|---|---|---|---|
| CN | 202791393 | U | 3/2013 |
| CN | 203036318 | U | 7/2013 |
| CN | 104613348 | A | 5/2015 |
| CN | 205014184 | U | 2/2016 |
| CN | 204879736 | U | 12/2016 |
| CN | 106594589 | A | 4/2017 |
| CN | 206386769 | U | 8/2017 |
| EP | 2 390 564 | A2 | 11/2011 |

* cited by examiner

SPIRAL AIR GUIDE DEVICE AND STAGE LIGHT HEAT DISSIPATION SYSTEM PROVIDED WITH THE SPIRAL AIR GUIDE DEVICE

TECHNICAL FIELD

The invention relates to the technical field of stage lights, in particular to a spiral air guide device and a stage light heat dissipation system provided with the spiral air guide device.

BACKGROUND OF THE INVENTION

In the field of stage lights, the stage light that is used typically has high power, especially at the light source part, such as a stage light using a gas discharge light as a light source. Since this type of light source is constrained by the technical characteristics thereof during operating process, only a very small amount of electric energy can be converted into visible light, and most of the electric energy is converted into forms like heat, infrared rays, and ultraviolet rays, etc. to be consumed away, so that a large amount of heat is often generated during work, and further the heat is transferred to the light source, resulting in an excessive temperature of the light source (for example, a bulb), thereby influencing the using effect and the service life of lights, and even leading to serious consequences such as bulb explosion or bulb turning white. Therefore, the light source part of the stage light needs heat dissipation and cooling.

Nowadays a blower is adopted for heat dissipation in most cases, however, for a general fixed blower heat dissipation system, the heat dissipation mode of a bulb is that the airflow direction is straight-flow, that is, one end is for air inlet and the other end is for air outlet. The airflow force close to the blower outlet is very strong while the airflow force far away from the blower outlet is very weak, and a heat insulation sheet has four dead angles, resulting in the bulb being unevenly heated and temperature difference between two sides of the bulb is large, which severely affects the service life of the bulb.

SUMMARY OF THE INVENTION

The purpose of the present invention is to overcome the defects in the prior art, and provides a spiral air guide device, through the arrangement of several horn-shaped air inlet ducts which are formed by gaps between adjacent protrusions and the protrusions are spirally arranged, the air inlet mode is circumferentially spiral, and opening sizes of the air inlet ducts are not equal and graded gradually. Such an arrangement allows sizes of the air inlet ducts to change uniformly, so that airflow can be inlet uniformly to dissipate heat uniformly when the spiral air guide device is used.

In order to solve the above technical problems, the technical scheme adopted by the invention is as follows.

The invention provides a spiral air guide device, comprising an air guide main body, wherein the air guide main body is provided with protrusions, the protrusions are spirally arranged and gaps between adjacent protrusions are formed into air inlet ducts in a horn shape, and opening sizes of the air inlet ducts are not equal and graded gradually.

According to the spiral air guide device, through the arrangement in which protrusions are spirally arranged and gaps between adjacent protrusions are formed into air inlet ducts in a horn shape, the air inlet mode is circumferentially spiral, and opening sizes of the air inlet ducts are not equal and graded gradually. Such an arrangement allows sizes of the air inlet ducts to change uniformly, so that air can be inlet uniformly to dissipate heat uniformly when the spiral air guide device is used.

Preferably, the bottom surface of the air inlet ducts is inclined so that the air inlet ducts can be formed into inclined air ducts. In addition, the opening size of a side (inlet) of each air inlet duct far away from a light transmitting area is graded gradually, and the opening size of a side (outlet) of each air inlet duct close to the light transmitting area is also graded gradually, wherein for each air inlet duct, the opening size of the side far away from the light transmitting area is larger than the opening size of the side close to the light transmitting area, and the difference range is greater than or equal to 2 mm, preferably 2 mm to 10 mm. Such an arrangement is to increase the pressure at the air inlet ducts so as to effectively guide air blown out by a heat dissipation source through an air outlet to a light source to dissipate heat effectively.

Preferably, the air guide main body is a cover-like structure, one side of the cover-like structure is provided with a concave portion and the protrusions are provided inside the concave portion of the cover-like structure.

The cover-like structure is provided with a light transmitting area, the light transmitting area is opposite to a light source of the stage light heat dissipation system and the protrusions are adjacent to the light transmitting area. Preferably, each protrusion surrounds the periphery of the light transmitting area.

The light transmitting area can be arranged by adopting several solutions. As a first solution, the light transmitting area is a second light through hole, and an outer side of the cover-like structure is provided with a light transmitting device which covers the second light through hole and forms an enclosed space with the second light through hole. Preferably, the light transmitting device is a glass heat insulation sheet and a fixing frame used for fixing the glass heat insulation sheet, and the glass heat insulation sheet and the fixing frame thereof enclose the periphery of the second light through hole into an enclosed space.

As a second solution, the light transmitting area is a light transmitting body integrally connected with the cover-like structure. Preferably, the light transmitting body is a glass insulation sheet, or a sheet made of other transparent materials that can transmit light.

The air guide main body is further provided with an air guide inlet.

In addition, an inner surface of the concave portion of the cover-like structure and the bottom surface of the air inlet ducts are integrally formed into an inclined plane, and specifically, the inner surface of the concave portion of the cover-like structure and the bottom surface of the air inlet ducts are inclined, that is, an inclined plane of the inner surface of the concave portion extends to the inclined bottom surface of the air inlet ducts and engages with the bottom surface to form an integral inclined plane. Such an arrangement is to increase the pressure at the air inlet ducts so as to effectively guide the air blown out by the heat dissipation source through the air outlet to the light source to dissipate heat effectively.

The invention further provides a stage light heat dissipation system provided with the spiral air guide device, including a heat dissipation cavity and a light source arranged in the heat dissipation cavity, wherein the heat dissipation cavity includes a heat dissipation source for blowing out cooling air and a spiral air guide device for guiding cooling air blown out by the heat dissipation source to the light source, and the opening size of the air inlet ducts gradually increases from the air inlet ducts at a position adjacent to the heat dissipation source to the air inlet ducts at a position far away from the heat dissipation source.

According to the stage light heat dissipation system provided with the spiral air guide device, through the arrangement in which protrusions are spirally arranged and gaps between adjacent protrusions are formed into air inlet ducts in a horn shape, the air inlet mode is circumferentially spiral, the opening size of the air inlet ducts gradually increases from the air inlet ducts at a position adjacent to the heat dissipation source to the air inlet ducts at a position far away from the heat dissipation source, so that the opening size of the air inlet ducts close to the air outlet of the heat dissipation source is smaller, and the opening size of the air inlet ducts far away from the air outlet is larger, therefore sizes of the air inlet ducts changes uniformly and air is inlet uniformly for the entire light source so as to dissipated heat uniformly around the light source, to effectively control temperature difference of the entire light source within a minimum range, and to prolong the service life of the light source.

Preferably, the heat dissipation cavity includes a fixing plate for fixing the light source and the fixing plate is provided with a light through hole for a light beam emitted by the light source passing through. Such an arrangement can allow the light source to be fixed, and meanwhile subsequent structures dissipate heat effectively for the light source through the light through hole.

The concave part of the spiral air guide device is arranged to face the light source of the stage light heat dissipation system, so that the cover-like structure can be reliably installed on the fixing plate to form a reliable air guide space to facilitate heat dissipation for the light source.

Preferably, the spiral air guide device is installed at a position of the light through hole of the fixing plate, an enclosed air guide space is formed at the installation position of the air guide main body and the light through hole, and the air guide main body and the light source are in a relative position and are located on two sides of the light through hole. Such an arrangement is to enable dissipating heat effectively for the light source from the light through hole by using the cover-like structure.

Preferably, the fixing plate is provided with a first mounting hole for placing the heat dissipation source, and the heat dissipation source and the air guide main body are located on the same side of the fixing plate. Such an arrangement is to install the heat dissipation source, and meanwhile to facilitate airflow of the heat dissipation source to be directly blown to the cover-like structure. Preferably, the stage light heat dissipation system is further provided with a fixing structure for fixing the heat dissipation source.

Preferably, the heat dissipation source is a blower, and the blower is provided with an air outlet for air discharging. It is to be noted that this is only preferred and is not intended to be limiting.

Preferably, the protrusions uniformly surround the periphery of the light through hole. Such an arrangement is to form a uniform air inlet duct to dissipate heat uniformly.

Preferably, the air outlet of the blower is correspondingly connected with the air guide inlet of the spiral air guide device. Such an arrangement is to better dissipate heat for the light source.

Preferably, the heat dissipation cavity further includes a heat insulation plate arranged around the light source and a heat sink provided at the bottom of the light source, and the heat dissipation cavity is made of the heat insulation plate, the fixing plate and the heat sink. Such an arrangement is to effectively dissipate heat for the light source, and meanwhile to prevent other equipment from scalding by heat emitted by the light source.

Preferably, the heat dissipation plate is further provided with a heat dissipation fan. Such an arrangement is to expedite heat dissipation and to prolong the service life of the light source.

Compared with the prior art, the beneficial effects of the present invention are as follows.

The present invention provides a spiral air guide device, through the arrangement in which protrusions are spirally arranged and gaps between adjacent protrusions are formed into air inlet ducts in a horn shape, the air inlet mode is circumferentially spiral, and opening sizes of the air inlet ducts are not equal and graded gradually. Such an arrangement allows sizes of the air inlet ducts to change uniformly, so that air can be inlet uniformly to dissipate heat uniformly when the spiral air guide device is used.

The present invention further provides a stage light heat dissipation system provided with the spiral air guide device, through the arrangement in which the protrusions are spirally arranged and gaps between adjacent protrusions are formed into air inlet ducts in a horn shape, the air inlet mode is circumferentially spiral, and opening sizes of the air inlet ducts gradually increases from the air inlet ducts at a position close to the heat dissipation source to the air inlet ducts at a position far away from the heat dissipation source, so that the opening size of the air inlet ducts close to the air outlet of the heat dissipation source is smaller, and the opening size of the air inlet ducts far away from the air outlet is larger, so as to allow sizes of the air inlet ducts to change uniformly and to inlet air uniformly for the entire light source to dissipate heat around the light source uniformly, to effectively control temperature difference of the entire light source within a minimum range, and to prolong the service life of the light source. An air inlet horn mouth at the air inlet ducts close to the cover-like structure is the smallest air inlet duct, and the air inlet horn mouth at the air inlet ducts far away from the cover-like structure is the largest air inlet duct. Thus air blown out by the blower is guided via each air inlet duct, and then enters into the heat dissipation cavity through the light through hole of the heat dissipation cavity, so as to inlet air uniformly for the entire light source and uniformly dissipate heat around the light source to effectively control the temperature difference of the entire light source within a minimum range and to prolong the service life of a bulb assembly.

DESCRIPTION OF EMBODIMENTS

Figure 1:
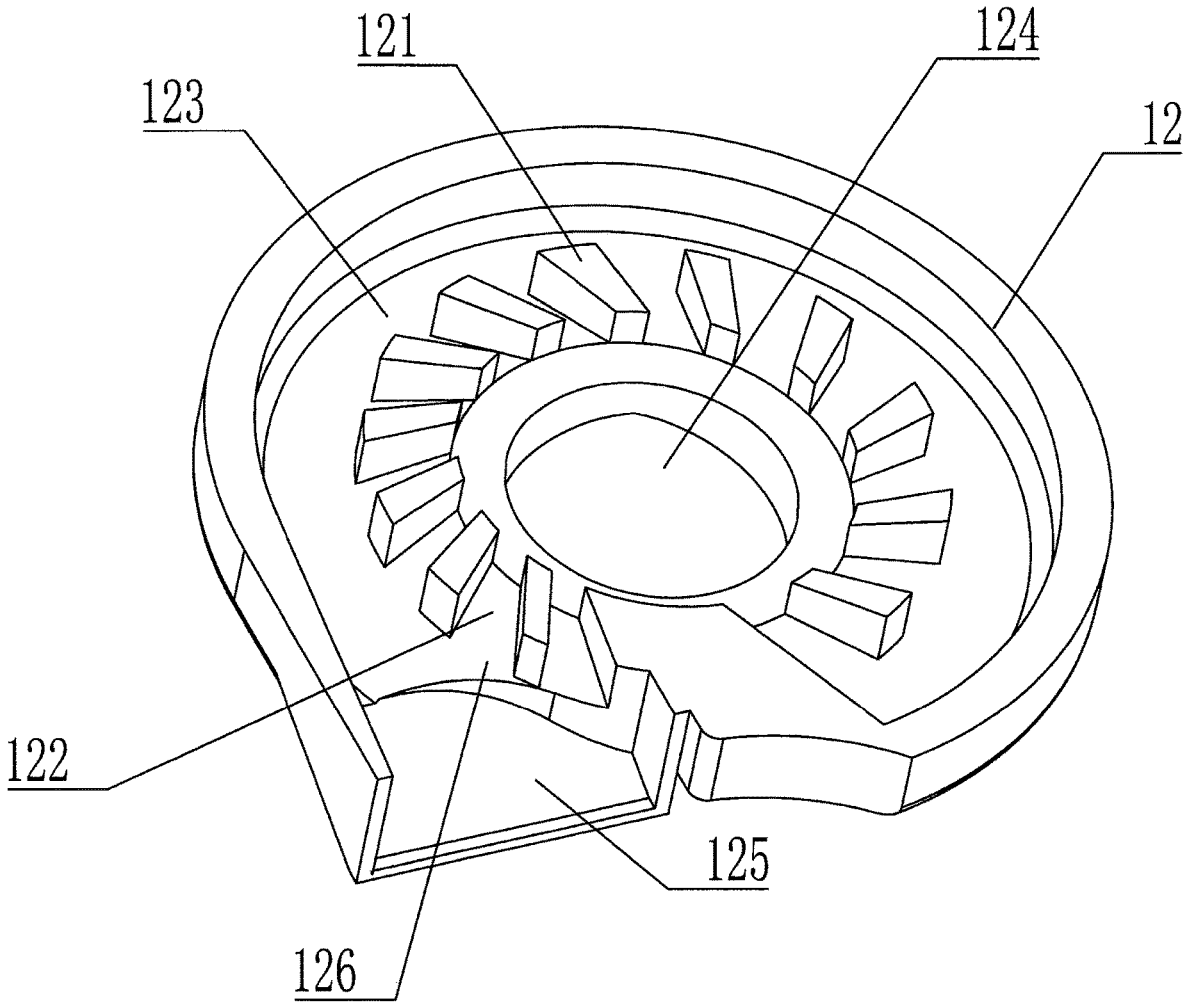
FIG. 1 is a schematic structural view of the spiral air guide device in embodiment 1.

The invention is further described below in conjunction with specific embodiments. The drawings are for illustration purpose only, which only represent a schematic diagram but not a physical picture, and are not intended to limit the present invention. Some components in the drawings are omitted, enlarged or reduced for better illustrating the embodiments of the invention, and sizes of these components do not represent actual sizes of them. For those skilled in the art, it will be understood that some known structures in the drawings and descriptions thereof are omitted.

The same or similar reference numbers in the drawings of embodiments of the present invention correspond to the same or similar parts. In the description of the present invention, it is to be understood that the terms "upper", "lower", "left", "right", and the like indicating relationships of directions and positions are based on relationships of directions and positions shown in the drawings, and are intended to be illustrative and simplify descriptions only and not to indicate or imply that the referred device or element must be provided in a particular direction, configured and operated in a particular direction. Therefore the terms used to describe relationships of positions are intended to be illustrative only and are not intended to limit the present invention. For those skilled in the art, specific meanings of the above terms can be understood according to specific situations.

Embodiment 1

As shown in FIGS. 1 to 4, a first embodiment of the spiral air guide device includes an air guide main body 12, wherein the air guide main body 12 is provided with protrusions 121, the protrusions 121 are spirally arranged, gaps between adjacent protrusions 121 are formed into air inlet ducts 122 in a horn shape, and opening sizes of the air inlet ducts 122 are unequal and graded gradually.

In addition, the air guide main body 12 is a cover-like structure, one side of the cover-like structure is provided with a concave portion 123 and the protrusions 121 are provided inside the concave portion 123 of the cover-like structure.

The cover-like structure is provided with a light transmitting area 124, through which the stage light emitted by the light source of the stage light heat dissipation system can be projected out. The protrusions 121 are adjacent to the light transmitting area 124. Specifically, each protrusion 121 surrounds the periphery of the light transmitting area 124.

Figure 2:
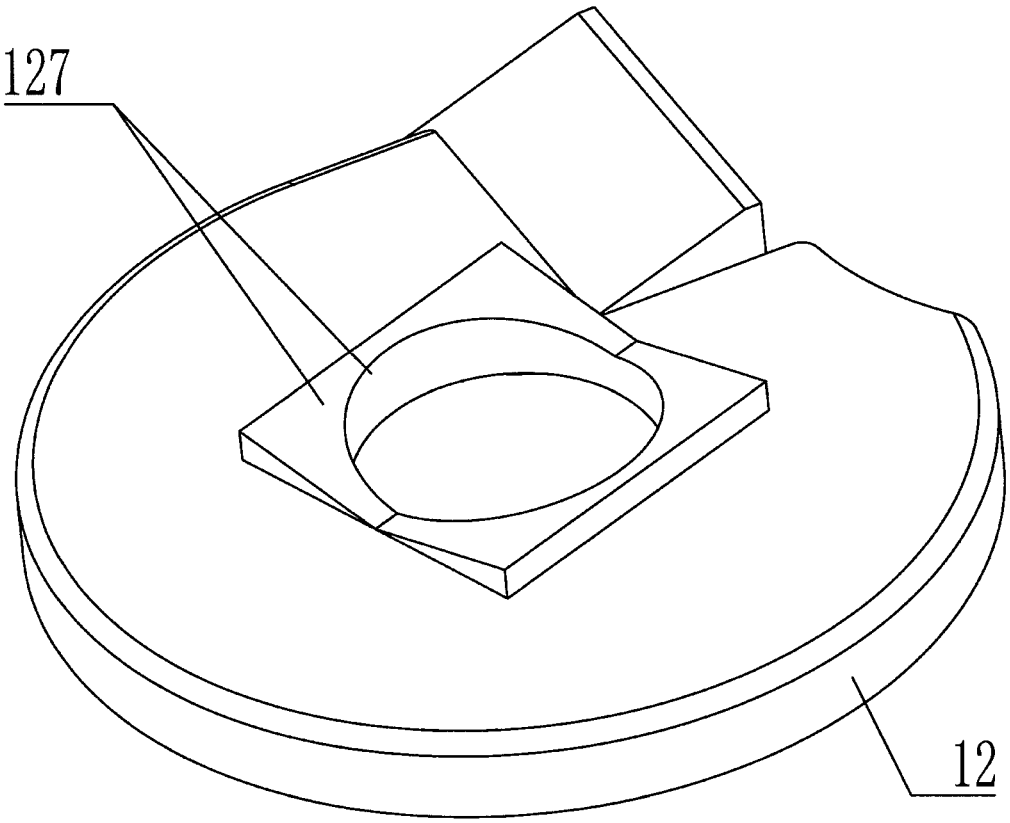
FIG. 2 is a schematic structural view viewed from a rear perspective of the spiral air guide device in embodiment 1.

The light transmitting area 124 is a second light through hole, as shown in FIG. 2, and an outer side of the cover-like structure is provided with a light transmitting device 127 covering the second light through hole and forming an enclosed space with the second light through hole. Specifically, the light transmitting device 127 is a glass heat insulation sheet and a fixing frame used for fixing the glass heat insulation sheet, and the glass heat insulation sheet and the fixing frame thereof enclose the outer side of the second light through hole to form an enclosed space.

As shown in FIG. 1, the air guide main body 12 is further provided with an air guide inlet 125.

Figure 3:
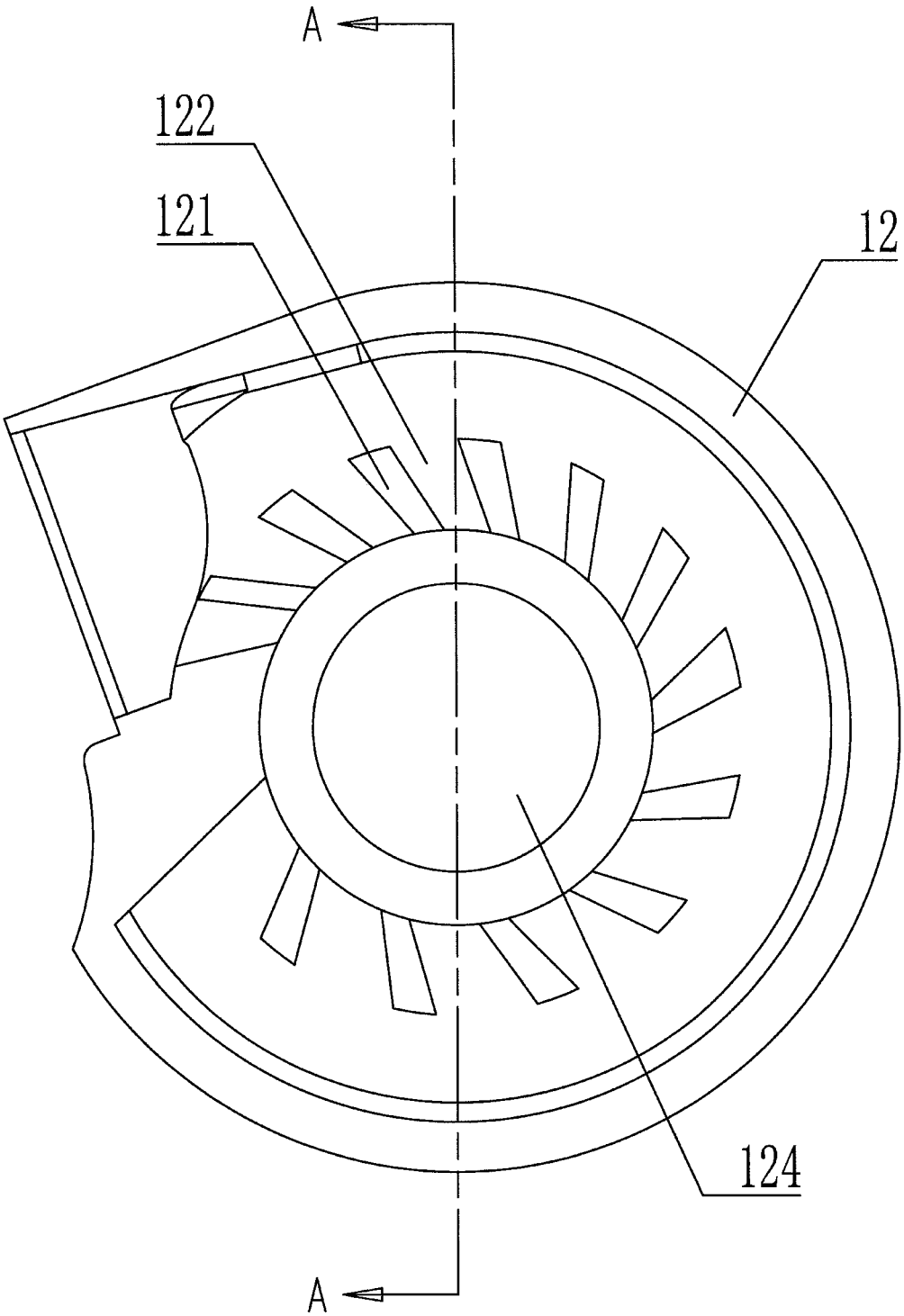
FIG. 3 is a schematic top view of the spiral air guide device in embodiment 1.
Figure 4:
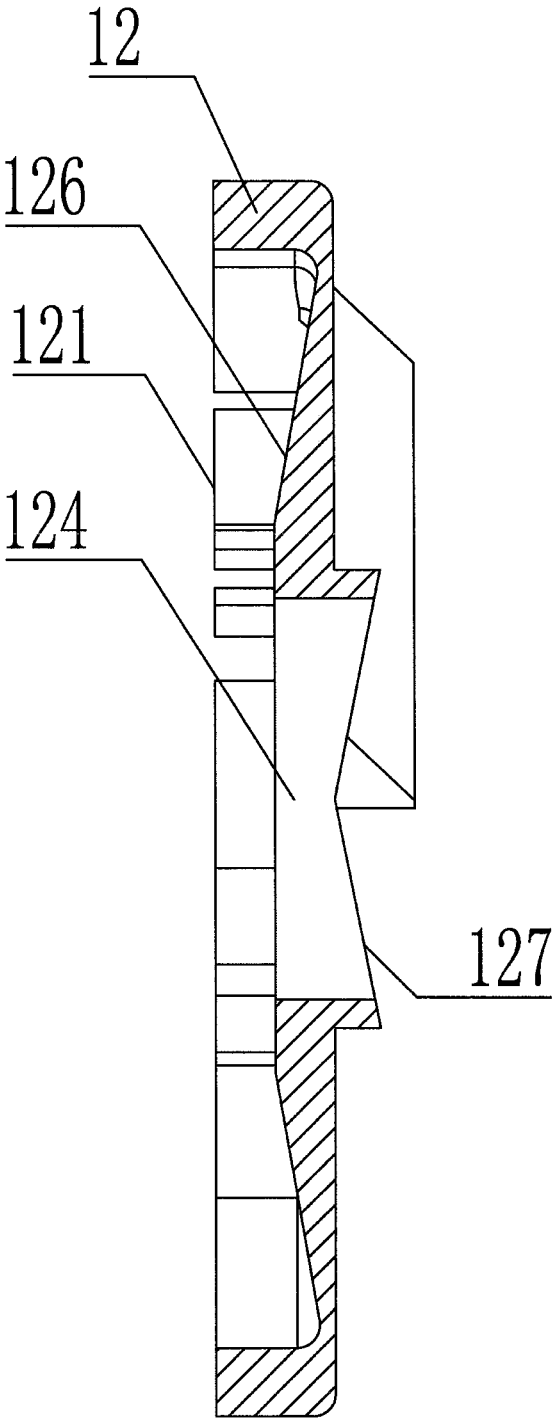
FIG. 4 is a cross-sectional view of FIG. 3 in an A-A direction.

In addition, as shown in FIGS. 3 and 4, the bottom surface 126 of the air inlet ducts 122 is inclined such that the air inlet ducts 122 are inclined air ducts. Further, the opening size of a side (inlet) of each air inlet duct 122 far away from a light transmitting area 124 is graded gradually, and the opening size of a side (outlet) of each air inlet duct 122 close to the light transmitting area 124 is also graded gradually, wherein for each air inlet duct 122, the opening size of the side far away from the light transmitting area 124 is not equal to the opening size of the side close to the light transmitting area 124. Specifically, for the air inlet ducts 122, the opening size of the side far away from the light transmitting area 124 is at least 2 mm larger than the opening size of the side close to the light transmitting area 124, preferably 2 mm to 10 mm. Such an arrangement is to increase the pressure at the air inlet ducts so as to effectively guide air blown out by a heat dissipation source through an air outlet to a light source to dissipate heat effectively.

In addition, an inner surface of the concave portion 123 of the cover-like structure and the bottom surface 126 of the air inlet ducts 122 are integrally formed into an inclined plane, as shown in FIG. 4, and specifically, the inner surface of the concave portion 123 of the cover-like structure and the bottom surface 126 of the air inlet ducts 122 are inclined, that is, the inner surface of the concave portion 123 extends in an inclined way to the inclined bottom surface 126 of the air inlet ducts 122 and engages with the bottom surface 126 to form an integral inclined plane, so that each air inlet duct 122 inside the air guide main body can be formed as an inclined air inlet duct to increase the pressure of air inlet, so as to effectively guide the air blown out by the heat dissipation source through the air outlet to the light source to uniformly dissipate heat.

Embodiment 2

Figure 5:
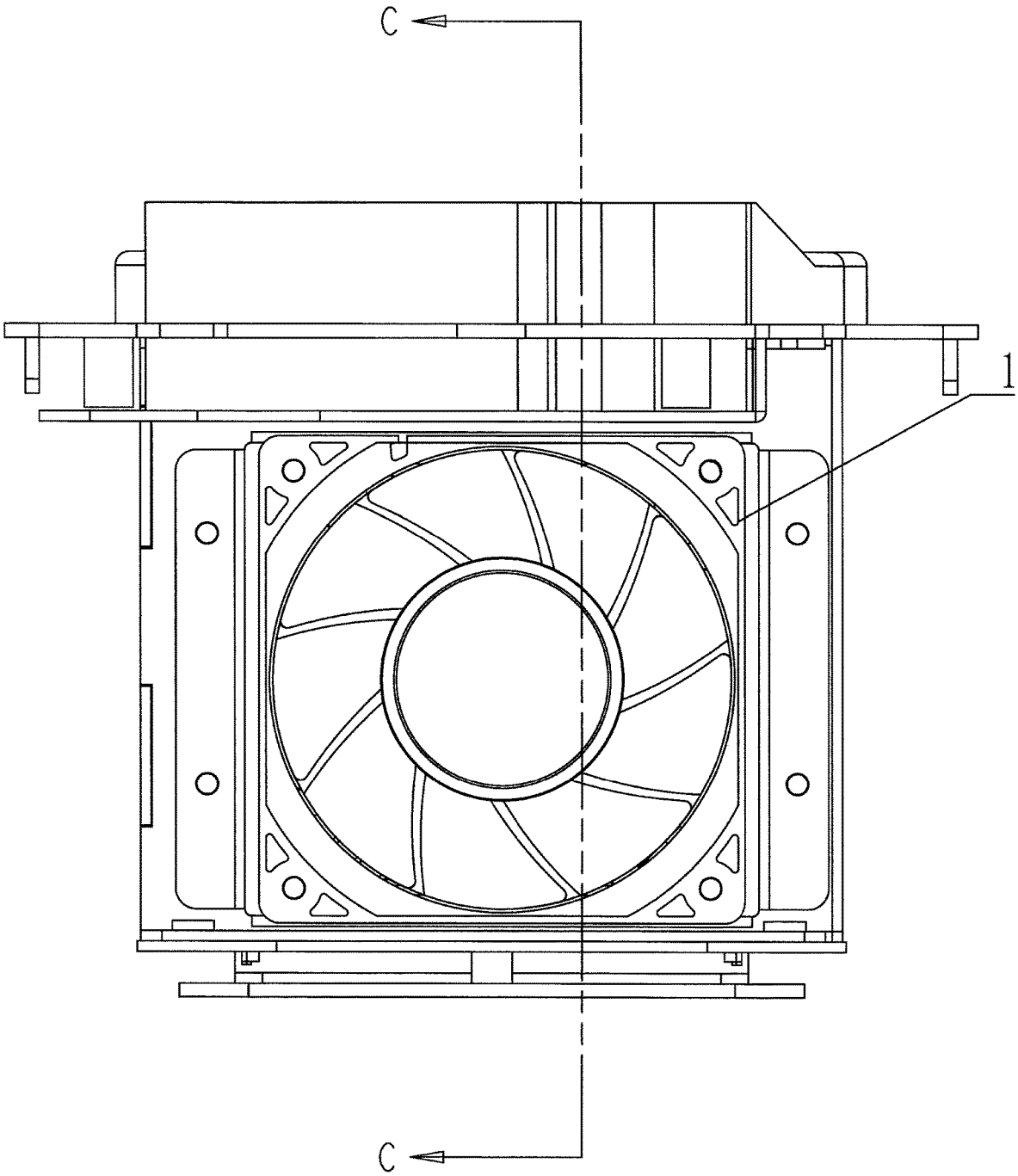
FIG. 5 is a schematic structural view of the stage light heat dissipation system provided with the spiral air guide device in embodiment 2.
Figure 6:
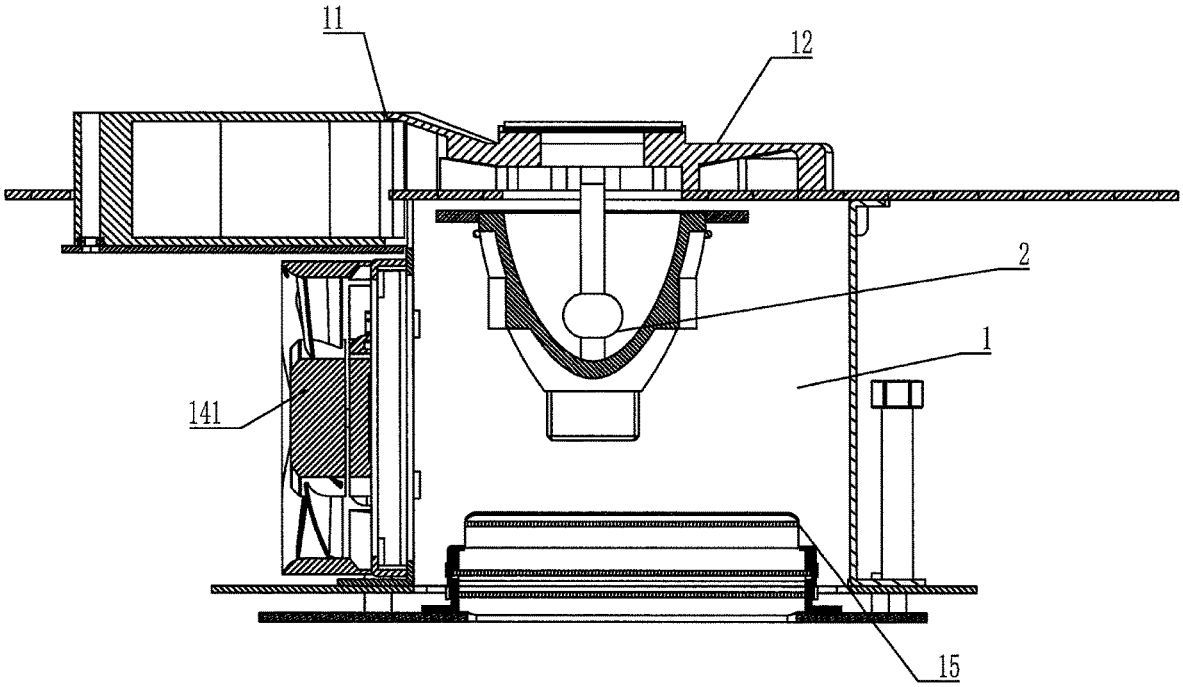
FIG. 6 is a cross-sectional view of FIG. 5 in a C-C direction.
Figure 7:
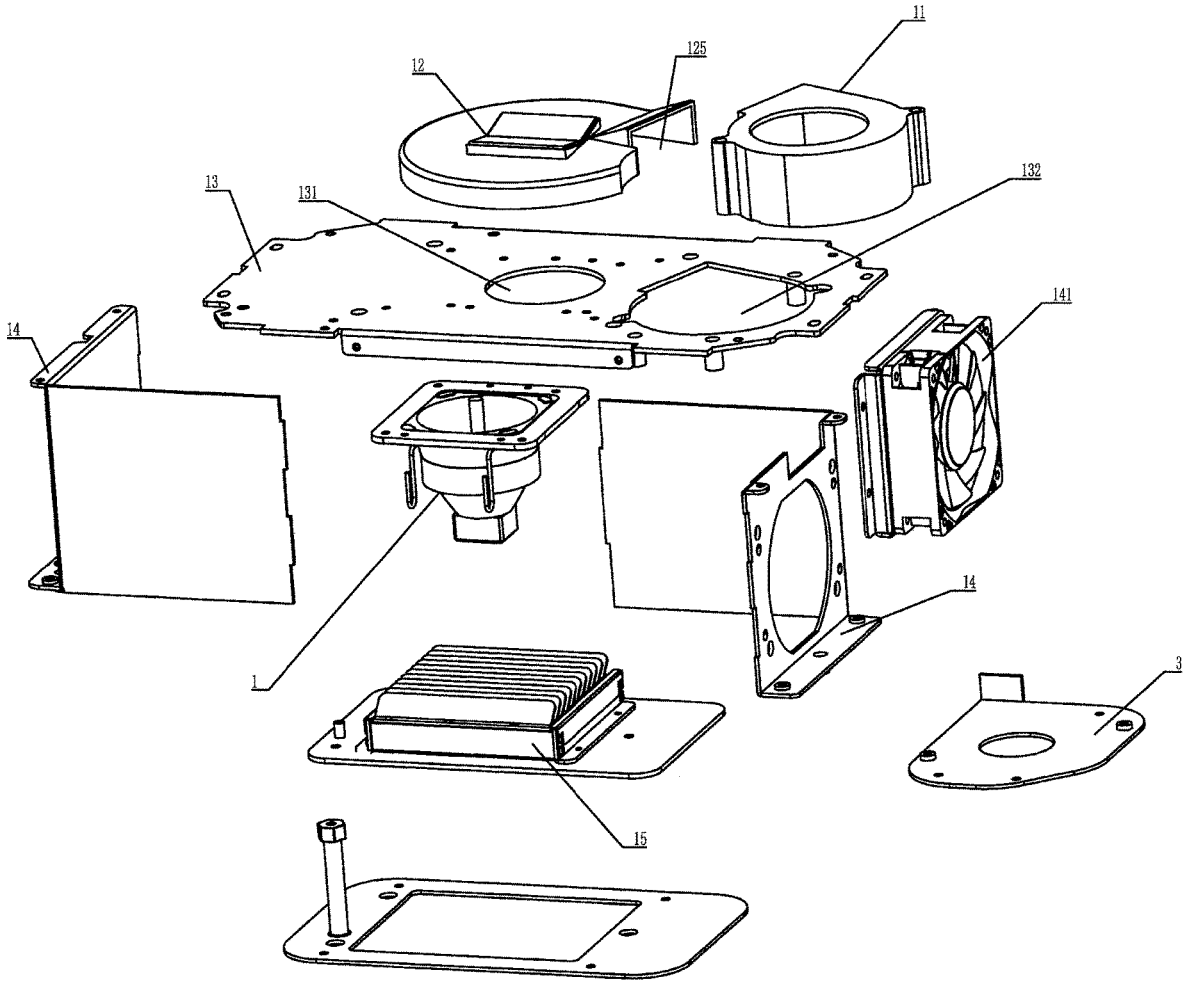
FIG. 7 is an exploded view of FIG. 5.

As shown in FIGS. 5 to 7, in a second embodiment, a stage light heat dissipation system provided with the spiral air guide device of embodiment 1 includes a heat dissipation cavity 1 and a light source 2 disposed inside the heat dissipation cavity 1, wherein the heat dissipation cavity 1 includes a heat dissipation source 11 for blowing out cooling air and a spiral air guide device for guiding air blown out by the heat dissipation source 11 to the light source 2, and opening sizes of the air inlet ducts 122 increase gradually from the air inlet ducts 122 at a position close to the heat dissipation source 11 to the air inlet ducts 122 at a position away from the heat dissipation source 11. Specifically, from the position close to the heat dissipation source 11 to the position far away from the heat dissipation source 11, the opening size of the side (inlet) of each air inlet duct 122 far away from the light transmitting area 124 gradually increases, and the opening size of the side (outlet) of each air inlet duct 122 close to the light transmitting area 124 also gradually increases.

The heat dissipation cavity 1 includes a fixing plate 13 for fixing the light source 2, and the fixing plate 13 is provided with a light through hole 131 for the light source 2 passing through. Such an arrangement can fix the light source 2, and meanwhile subsequent structures dissipate heat for the light source 2 through the light through hole.

The concave portion 123 of the spiral air guide device is arranged to face the light source of the stage light heat dissipation system, so that the cover-like structure can be reliably installed on the fixing plate 13 to form a reliable air guide space, and to facilitate heat dissipation for the light source.

In addition, the spiral air guide device is installed at a position of the light through hole 131 of the fixing plate 13, an enclosed air guide space is formed at the installation position of the air guide main body 12 and the light through hole 131, and the air guide main body 12 and the light source 2 are in a relative position and are located on two sides of the light through hole 131. Such an arrangement allows air blown out by the heat dissipation source 11 to pass through the light through hole 131 via the air guide main body 12 and enter into the heat dissipation cavity 1 to effectively dissipate heat for the light source 2.

The fixing plate 13 is provided with a first mounting hole 132 for placing the heat dissipation source 11, and the heat dissipation source 11 and the air guide main body 12 are located on the same side of the fixing plate 13. Such an arrangement is to install the heat dissipation source 11, and meanwhile to facilitate air from the heat dissipation source 11 to be directly blown to the spiral air guide device. Preferably, the stage light heat dissipation system is further provided with a fixing structure 3 for fixing the heat dissipation source.

In addition, the heat dissipation source 11 is a blower, the blower is provided with an air outlet for air discharging, and the air outlet is correspondingly connected with the air guide inlet 125. It is to be noted that this is only preferred and is not intended to be limiting.

In addition, the protrusions 121 uniformly surround the periphery of the light through hole 131. Such an arrangement is to form a uniform air inlet duct to dissipate heat uniformly.

The air outlet of the blower is correspondingly connected with the air inlet ducts which are formed by gaps between the protrusions 121 in a horn shape. Such an arrangement is to better dissipate heat for the light source.

In addition, the heat dissipation cavity 1 further includes a heat insulation plate 14 arranged around the light source 2 and a heat sink 15 provided at the bottom of the light source 2, and the heat dissipation cavity 1 is made of the heat insulation plate 14, the fixing plate 13 and the heat sink 15. Such an arrangement is to effectively dissipate heat for the light source, and meanwhile to prevent other equipment from scalding by heat emitted by the light source.

The heat insulation plate 14 is further provided with a heat dissipation fan 141. Such an arrangement is to expedite heat dissipation and to prolong the service life of the light source. The light source of the present embodiment is a light bulb assembly.

Embodiment 3

As shown in FIGS. 1 to 4, the present embodiment is similar to embodiment 1, the differences are that the light transmitting area 124 is a light transmitting body integrally connected with the cover-like structure, that is, the light transmitting body can be formed as a part of the cover-like structure, and can be made of glass or other heat insulation sheets or components of transparent and light transmitting materials.

Obviously, the above embodiments of the present invention are merely examples for clear illustration, and are not intended to limit the implementations of the present invention. Modifications or changes in other various forms can be made by those ordinary skilled in the art on the basis of the above description. There is neither need nor exhaustion for all implementations. Any modification, equivalent substitution, improvement, or the like within the spirit and principle of the invention should be included in the scope of the claims of the invention.

The invention claimed is:

1. A spiral air guide device, comprising:

an air guide main body; and protrusions provided on the air guide main body, wherein the protrusions are spirally arranged and gaps between adjacent protrusions form air inlet ducts in a horn shape, and opening sizes of the air inlet ducts are unequal and graded gradually;

wherein the air guide main body is a cover-like structure;

wherein the cover-like structure is provided with a light transmitting area, and the protrusions are adjacent to the light transmitting area.

2. The spiral air guide device according to claim 1, wherein a bottom surface of the air inlet ducts is inclined.

3. The spiral air guide device according to claim 1, wherein one side of the cover-like structure is provided with a concave portion, and the protrusions is provided in the concave portion of the cover-like structure.

4. The spiral air guide device according to claim 1, wherein the light transmitting area is a second light through hole, an outer side of the cover-like structure is provided with a light transmitting device which covers the second light through hole and forms an enclosed space with the second light through hole, and alternatively, the light transmitting area is a light transmitting body integrally connected with the cover-like structure.

5. The spiral air guide device according to claim 1, wherein the opening size of a side of the air inlet ducts far away from the light transmitting area is at least 2 mm larger than the opening size of a side close to the light transmitting area.

6. The spiral air guide device according to claim 3, wherein an inner surface of the concave portion of the cover-like structure forms an integral inclined plane with the bottom surface of the air inlet ducts.

7. The spiral air guide device according to claim 1, wherein the air guide main body is further provided with an air guide inlet.

8. A stage light heat dissipation system provided with a spiral air guide device comprising an air guide main body, protrusions provided on the air guide main body, wherein the protrusions are spirally arranged and gaps between adjacent protrusions form air inlet ducts in a horn shape, and the opening sizes of the air inlet ducts are unequal and graded gradually, the stage light heat dissipation system comprising:

a heat dissipation cavity; and a light source disposed inside the heat dissipation cavity, wherein the heat dissipation cavity comprises a heat dissipation source for blowing out cooling air and the spiral air guide device for guiding cooling air blown out by the heat dissipation source to the light source, the opening size of the air inlet ducts increases gradually from the air inlet ducts at a position close to the heat dissipation source to the air inlet ducts at a position far away from the heat dissipation source.

9. The stage light heat dissipation system according to claim 8, wherein the heat dissipation cavity comprises a fixing plate for fixing the light source, and a light through hole for a light beam emitted by the light source passing through is arranged on the fixing plate.

10. The stage light heat dissipation system according to claim 9, wherein the spiral air guide device is installed at the position of the light through hole of the fixing plate, an enclosed air guide space is formed at the installation position of the air guide main body and the light through hole, and the air guide main body and the light source are in a relative position and are located on two sides of the light through hole.

11. The stage light heat dissipation system according to claim 9, wherein the fixing plate is provided with a first mounting hole for placing the heat dissipation source, and the heat dissipation source and the air guide main body are located on the same side of the fixing plate.

12. The stage light heat dissipation system according to claim 9, wherein the protrusions uniformly surround the periphery of the light through hole.

13. The stage light heat dissipation system according to claim 8, wherein the heat dissipation source is a blower, the blower is provided with an air outlet for air discharging, and the air outlet is correspondingly connected to the air guide inlet of the spiral air guide device.

14. The stage light heat dissipation system according to claim 8, wherein the heat dissipation cavity further comprises a heat insulation sheet provided around the light source and a heat sink provided at the bottom of the light source, and the heat dissipation cavity is made of the heat insulation sheet, the fixing plate, and the heat sink.

* * * * *